United States Patent [19]

Abbott et al.

[11] Patent Number: 4,512,172

[45] Date of Patent: Apr. 23, 1985

[54] METHOD OF FORMING FLANGED CONTAINERS

[75] Inventors: James B. Abbott, Newbury; Ernest O. Kohn, Abingdon; Christopher Berry, Wantage; Mark N. Slade, Farringdon, all of England

[73] Assignee: Metal Box plc, Reading, England

[21] Appl. No.: 359,654

[22] PCT Filed: Aug. 27, 1981

[86] PCT No.: PCT/GB81/00169

§ 371 Date: Mar. 5, 1982

§ 102(e) Date: Mar. 5, 1982

[87] PCT Pub. No.: WO82/00785

PCT Pub. Date: Mar. 18, 1982

[30] Foreign Application Priority Data

Sep. 8, 1980 [GB] United Kingdom ..... 8029005

[51] Int. Cl.[3] ..... B21D 19/06; B21D 22/00

[52] U.S. Cl. ..... 72/68; 72/84; 72/105; 72/348

[58] Field of Search ..... 72/68, 84, 86, 105, 72/106, 110, 348, 370; 413/1, 69

[56] References Cited

U.S. PATENT DOCUMENTS

| | | | |
|---|---|---|---|
| 3,029,667 | 4/1962 | Sporck | 72/105 |
| 3,196,819 | 7/1965 | Lechner et al. | 72/379 |
| 3,688,538 | 9/1972 | Hoyne | 72/94 |
| 3,964,413 | 6/1976 | Saunders | 72/370 |
| 3,995,572 | 12/1976 | Saunders | 72/348 |
| 4,058,998 | 11/1977 | Franek | 72/84 |
| 4,070,888 | 1/1978 | Gombas | 72/105 |
| 4,403,493 | 9/1983 | Atkinson | 72/356 |

*Primary Examiner*—Lowell A. Larson

*Attorney, Agent, or Firm*—Diller, Ramik & Wight

[57] ABSTRACT

A method of forming a smooth shoulder (**16, 14*b*, 19*b*), neck (17, 37) and flange (18, 38) at the open end of the cylindrical side wall (12) of a can body (10) comprises the steps of forcing a marginal edge portion (13) of the side wall into at least a first die to form a first portion of reduced diameter having a first shoulder portion (14) and a first cylindrical portion (15); and optionally applying at least one rolling operation to the first portion of reduced diameter, and any further die formed portions of reduced diameter subsequently formed, to generate a smooth shoulder (16, 14, 19*b*), neck (17, 37) and flange (18, 38). Reference is made to the roll forming process described and claimed in British Pat. No. 1,534,716 as being particularly suitable. The margin-portion (13) is preferably thicker than the rest of the side wall (12**).

15 Claims, 27 Drawing Figures

(a) (b) (c)

METHOD OF FORMING FLANGED CONTAINERS

TECHNICAL FIELD

This invention relates to methods of reducing the diameter of a marginal portion of a cylindrical body to produce a shoulder and neck and more particularly but not exclusively to a method of forming a can body having an outward directed flange on the neck.

BACKGROUND ART

Traditional methods of reducing the diameter of cylindrical bodies include "die necking" in which one end of the cylindrical body is forced into a conical die which exerts a compressive force to reduce the diameter and "roll necking" in which a roll is engaged with the exterior of the cylindrical body as it is rotated to generate the shoulder profile by a spinning or beading process.

U.S. Pat. No. 3,995,572 describes a method and apparatus for producing a seamless can body with a reduced diameter opening for receiving an aerosol valve. Starting with a cylindrical workpiece a truncated conical portion supporting a cylindrical portion of reduced diameter is formed by each of a sequence of dies to finally form a shoulder characterized by the curvilinear configuration imposed by each die. The disadvantage of this series of "die necking" operations is that each die only brings about a relatively small reduction in can diameter so that the expense of several press tools is incurred. Furthermore, the shoulder produced has a corrugated or stepped shape which is not always desirable.

Beverage cans are now well known in which the top of the side wall is necked in to receive an aluminium can end of diameter smaller than the outside diameter of the bulk of the can body. The objective in such cans is to use less aluminium can end material, thus the present invention also seeks to provide a method of making neck portions of reduced diameter.

These prior art cans are usually 2.585" (65.6 mm) diameter necked down to 2.462 (62.5 mm) diameter and made by one of several roll forming methods currently available.

In one known roll forming method, as described in British Pat. No. 1,330,346 (U.S. Pat. No. 3,688,538) a peripheral edge margin of the sidewall of the can body is spun on a mandrel as an external roll compresses the margin to generate a shoulder neck and flange. However, a collapsible mandrel is required to carry out this method. In another roll forming method, as described in our British Pat. No. 1,534,716, (U.S. Pat. No. 4,058,998) the can body is supported in axial compression while a marginal portion adjacent the open end of the body is deformed radially inwards by a pair of external rollers so that the combination of axial and radial forces generate a shoulder, neck and flange. This method requires only a simple solid chuck, because the neck is formed into free space.

DISCLOSURE OF THE INVENTION

Accordingly this invention provides a method of forming at least one shoulder, a neck and a flange at an open end of the cylindrical side wall of a can body said method comprising the steps (1) successively forcing a marginal edge portion defining the open end of the side wall into one or more dies of reducing diameter to make a portion of reducing diameter consisting of a corresponding number of shoulder portions supporting a cylindrical portion; and (2) applying rolls in at least one rolling operation to at least part of the portion of reducing diameter and cylindrical portion to further change the diameter of the cylindrical portion and generate at least one shoulder supporting the neck and flange.

According to a preferred embodiment of the method a pair of rolls applies a radial force in combination with an axial force on the can in a method claimed according to any of claims 1 to 9 or claim 22 of British Pat. No. 1,534,716. The method may be applied to can bodies of materials which tolerate severe cold work, the method comprising a simple die neck followed by rolling being suitable when the can body is made of aluminium or alloys thereof. When the can is made of metals which are less tolerant of cold work, extra die necking operations may be included in the method, for example when the body is made of tinplate or stiff aluminium alloy.

Although the die necking operations may not require a thickened side wall portion, a marginal edge portion thicker than the rest of the side wall may be used to avoid flange cracking arising from excessive work hardening.

When the rolling method claimed in British Pat. No. 1,534,716 is used the diameter of the cylindrical portion to which the roll is applied is preferably less than that of the diameter of the final flange produced.

The invention further provides a can body having a shoulder neck and flange when produced by the method described.

BRIEF DESCRIPTION OF THE DRAWINGS

Various embodiments of the invention will now be described by way of example only and with reference to the accompanying drawings in which.

MODE OF CARRYING OUT THE INVENTION

Figure 1:
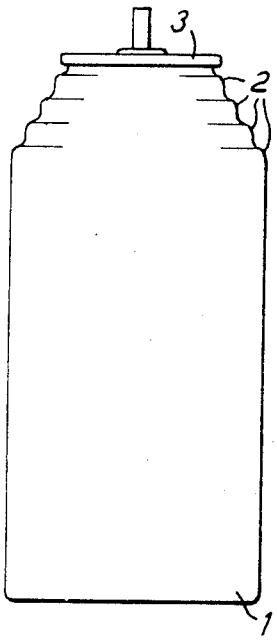
FIG. 1 PRIOR ART
FIG. 1 is a side elevation of an aerosol can produced by a prior art die necking process.

In FIG. 1 an aerosol can 1 drawn from sheet metal, has a shoulder characterised by a series of steps 2 each of which was made by a die necking operation. As depicted the reduced aperture of the top of the shoulder of the aerosol can is closed by a valve cup 3.

Figure 2:
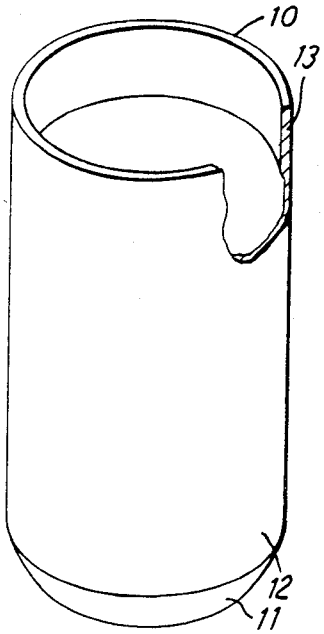
FIG. 2 is a perspective sketch of a beverage can body broken away to show side wall thickness.

FIG. 2 shows a beverage can body 10 such as is produced from a sheet metal blank by drawing a cup which is then wall ironed to create a can having a bottom wall 11 substantially equal in thickness to the blank and side wall 12 thinner than the bottom wall 11. It is customary for such can bodies to be formed with a marginal portion 13 of thicker metal around the open end of the side wall. This marginal portion of metal thicker than the rest of the side wall is better able to tolerate flanging and subsequent fitting of a can end by double seaming. Had the can body of FIG. 1 been formed by deep drawing to a shallow height, the side wall material would not necessarily be so work hardened as to need the thicker marginal portion.

Figure 3:
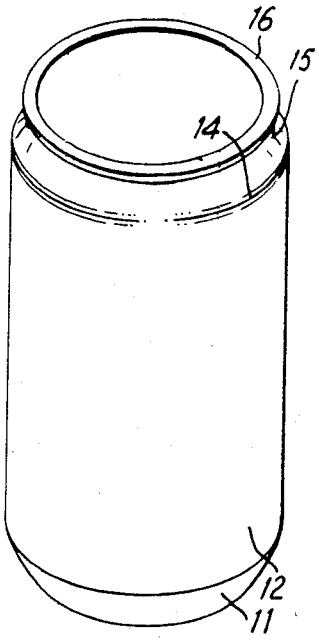
FIG. 3 is a perspective sketch of the can body of FIG. 2 after forming of the shoulder, neck and flange.

FIG. 3 shows the can body of FIG. 2 after the marginal portion 13 has been formed into a shoulder 14, neck 15 and flange 16 by a method including a sequence of die necking and rolling operations.

Figure 4:
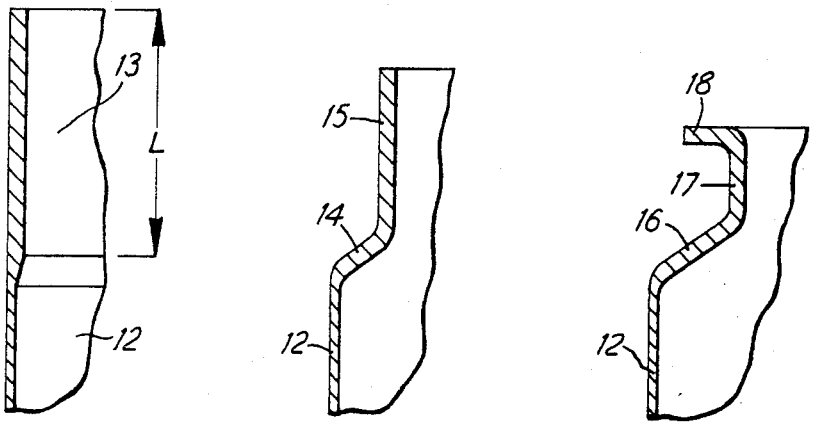
FIGS. 4*a, b* and *c* show diagrammatically fragmentary sections of the side wall at various stages of the formation of a shoulder, neck and flange in a first embodiment of the method.
Figure 6:
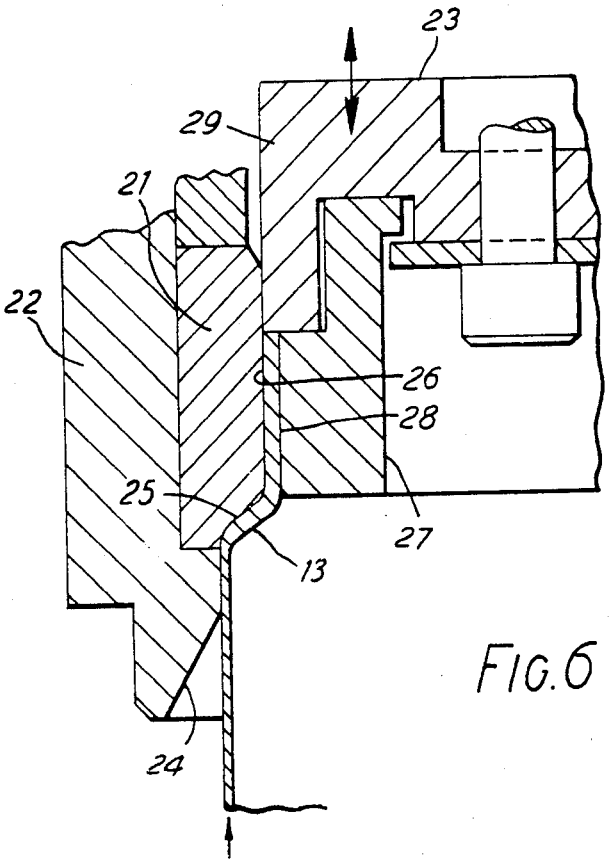
FIG. 6 is a sectioned elevation of part of a die necking tool.

FIG. 4 shows diagrammatically one embodiment of the method which includes the steps of taking a 2.585" (65.6 mm) diameter aluminium alloy can having a side wall ironed to 0.005" (0.127 mm) but provided with a thicker margin portion 13 about 0.008" (0.203 mm) thick. The axial length of the marginal portion is denoted "L" in FIG. 4(*a*) depends on the length of the final shoulder, neck and flange to be generated. This is because it is desirable to have a shoulder, neck and flange made from the thicker marginal material so that it can support the loads arising during the seaming on of a can end and thereafter when cans are stacked in transit. In this example the axial length "L" is about 0.55" (14 mm) to permit necking in from the 2.585" (65.6 mm) diameter to a final internal neck diameter of 2.360" (59.9 mm). In FIG. 4(*b*) the marginal portion 13 of FIG. 4(*a*) has been forced into a die to form a first portion of reduced diameter having a first shoulder portion 14 which supports a first cylindrical portion 15 of internal diameter of approximately 2.463" (62.6 mm). The die used for this operation is shown in FIG. 6 and will be described later. In FIG. 4(*c*) the first portion of reduced diameter depicted in FIG. 4(*b*) is depicted after roll forming by means of the apparatus of FIGS. 7 and 8, to further reduce the diameter of the first cylindrical portion 15 and generate a smooth shoulder 16 supporting a neck 17 and flange 18. The internal diameter of the neck 17 is 2.360" (59.9 mm).

Whilst this method described with reference to FIG. 4 is appropriate for metals such as aluminium and its alloys which are tolerant of cold work, metals such as steel and tinplate may require additional die reductions before roll forming to achieve equivalent total reductions in can diameter.

Figure 5:
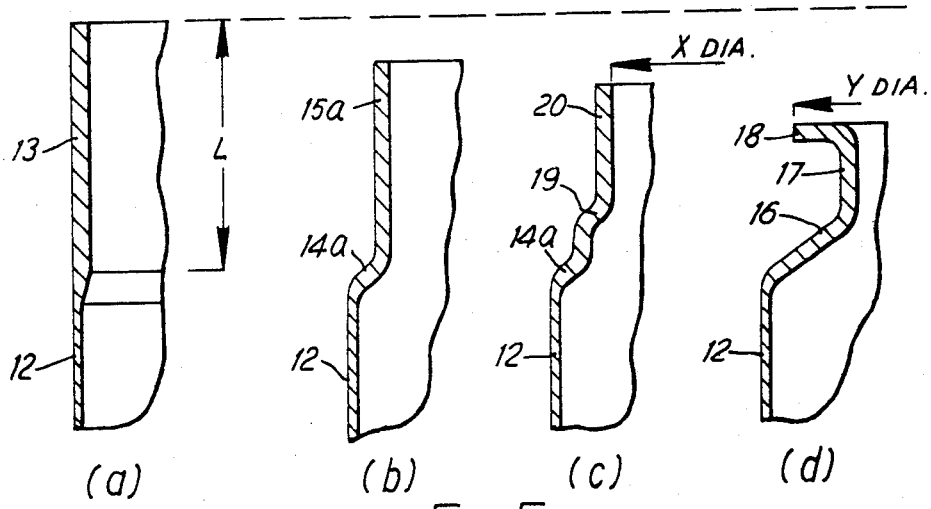
FIGS. 5*a,b,c, & d* show diagrammatically fragmentary sections of the side wall during a second embodiment of the method.

FIG. 5 shows diagrammatically a sequence of operations for the formation of a neck having an internal diameter of 2.260" (57.4 mm) on a wall ironed tinplate can body of 2.585" (65.6 mm) diameter. In FIG. 5(*a*) like portions of the can body are denoted with the same symbols as used previously.

The side wall 12 is of thickness 0.004" (0.1 mm), the marginal portion 13 has a thickness of 0.006" (0.15 mm) and the axial length "L" of the marginal portion 13 is about 0.60" (15 mm). In FIG. 5(*b*) the marginal portion 13 of FIG. 5.(*a*) has been forced into a die similar to that shown in FIG. 6 to make a first portion of reduced diameter having a first shoulder portion 14(*a*) supporting a first cylindrical portion 15(*a*) of 2.510" (63.7 mm) diameter. In FIG. 5(*c*) the first portion of reduced diameter depicted in FIG. 5(*b*) has been forced into a second die to further reduce the diameter of the first cylindrical portion 15(*a*) and form a second portion of further reduced diameter having a second shoulder portion 19 and second cylindrical portion 20 of 2.410" (61.2 mm) diameter. FIG. 5(*d*) shows the smooth shoulder 16, neck 17 and flange 18 generated by application of a roll to the first and second portions of reduced diameter depicted in FIG. 5(*c*).

The method described with reference to FIG. 5 may be adapted to reduce the neck diameter of an aluminium can by use of the reductions tabulated in TABLE 1, in which the reductions for a tin plate can are shown to permit comparison:

| "L" | Starting body | First Die Neck | Second Die Neck | Rollneck/ flange |
|---|---|---|---|---|
| | Aluminium | | | |
| 0.495" (12.6 mm) | 2.585"dia (65.6 mm) | 2.480" (63 mm) | 2.360" (59.9 mm) | 2.260" (57.4 mm) |
| | Tinplate | | | |
| 0.600" (15.2 mm) | 2.585"dia (65.6 mm) | 2.510" (63.8 mm) | 2.410" (612 mm) | 2.260" (57.4 mm) |

FIG. 6 shows a first die such as is used to make the first portion of reduced diameter such as those shown in FIGS. 4(*b*) and 5(*b*). As the principles of such dies are understood in the art and apply to all the diameter reductions considered in this specification, the operation of only the one die will be described. In FIG. 6 the apparatus comprises an external annular necking die insert 21 supported in an annular housing 22, and mandrel 23 movable in an axial direction relative to the die insert.

The annular housing 22 has a frustoconical surface 24 which serves to lead the marginal portion 13 of a can body centrally to an inwardly centered surface 25 of the die insert. The surface 25 of the die insert continues to a cylindrical surface 26. The mandrel comprises a centring ring 27 having a cylindrical work surface 28 and a support ring 29 which supports the centering ring 27. The working surface 28 of the centering ring 27 and the cylindrical surface 26 of the die insert are spaced apart a distance sufficient to permit the deformed marginal portion of a can to pass between until the leading edge of the can abuts the support ring so that the height of the die necked can is controlled as shown in FIG. 6. In use, a can body is pushed into the apparatus so that the surface 24 guides the leading edge of the marginal portion 13 to the inwardly centred surface 25 of the die insert; the leading edge is deflected towards the working surface 28 of the centring ring 27 which in turn directs the leading edge up into the gap between the cylindrical working surface 28 of the mandrel and the cylindrical surface 26 of the die insert. Continued upward movement of the can body forms the first cylindrical portion of the neck until the leading edge abuts the support ring 29. The can is then ejected from the apparatus by moving the support ring 29 and centring ring 27 downwards to clear the die insert 21. Once the necked can has been ejected the apparatus is returned to the position depicted in FIG. 6 in readiness for another can body.

Figure 7:
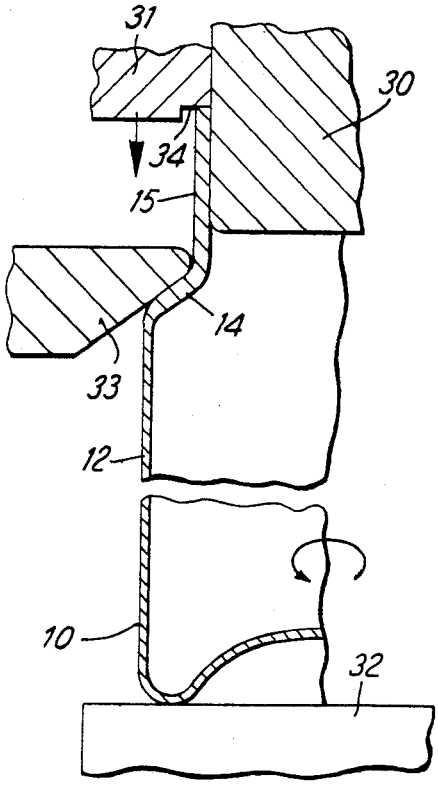
FIG. 7 is a sectioned elevation of part of a roll forming apparatus before roll forming.
Figure 8:
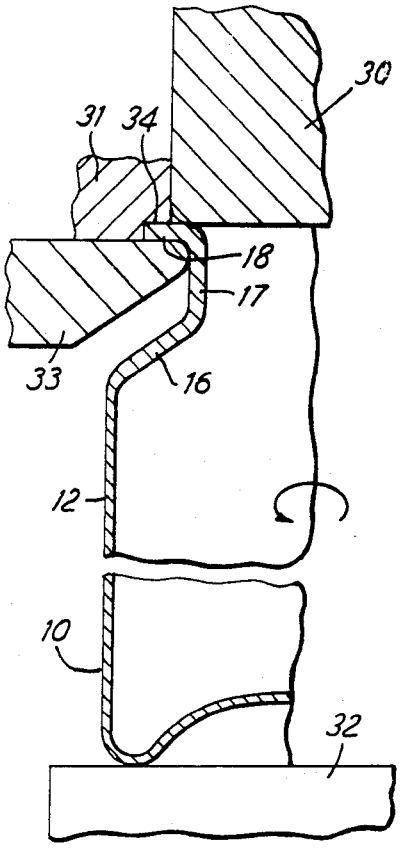
FIG. 8 is a like view to FIG. 7 but showing the apparatus after roll forming of neck and flange.

FIGS. 7 and 8 show apparatus, for rolling a neck and flange into the side wall of a can body, as is described fully in British Pat. No. 1,534,716 (U.S. Pat. No. 4,058,998) to which the reader is directed for a full description. In simple terms the apparatus comprises a chuck 30 surrounded by a control ring 31, a lifter pad 32 movable towards and away from the chuck 30 and a pair of freely rotating work rolls 33 only one of which is shown.

In FIG. 7 a can body 10 is depicted just before the work rolls start work. The can body clamped between the control ring 31 and the lifter pad 32 is held central to an axis of rotation by the chuck 30. The whole assembly of chuck 30, control ring 31, can 10 and lifter pad 32 are rotated about the axis of rotation and the work rolls 33 are moved radially inwards, by a cam (not shown), towards the axis to bear upon the shoulder portion 14 and first cylindrical portion 15.

The neck and flange are formed by regulating the downward axial motion of control ring 31 and lifter pad 32 relative to the work rolls 33 to generate the finished can shoulder 16, neck 17 and flange 18.

It will be noticed that in FIG. 8 the shoulder portion 16 and neck 17 are formed into free space, no collapsible mandrel having been used.

Figure 9:
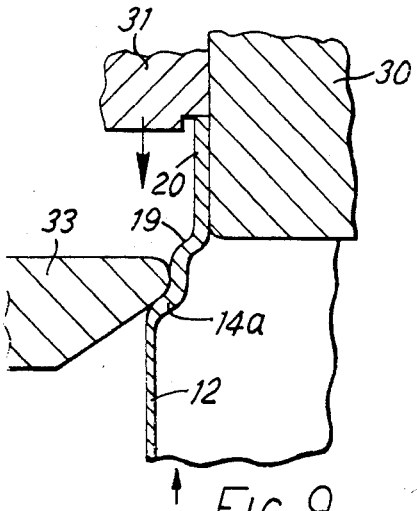
FIG. 9 is a like view to FIG. 7 showing apparatus for roll forming a component which has been die necked twice.
Figure 10:
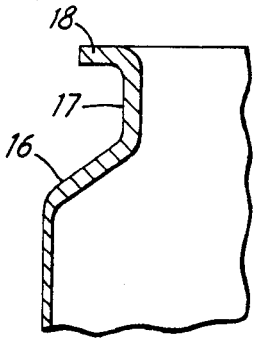
FIG. 10 is a fragmentary section of the shoulder, neck and flange produced by the apparatus of FIG. 9.

FIG. 9 shows how the same apparatus of FIGS. 7 and 8 is used to reform a die necked can having first and second portions of reduced diameter, as was described with reference to FIG. 5(*c*), into the finished can having a smooth shoulder 16, neck 17 and flange 18 of FIG. 10. As shown in FIG. 9 the work rolls such as that denoted 33 can be seen to first engage with the first reduced portion 14(*a*) as the can rotates. The shoulder, neck and flange are then generated as control ring and lifter pad move downwards in relation to the chuck. As can best be understood from FIG. 8, it will be seen that the peripheral edge of the flange 18 finally flips outwardly to be formed between an annular recess 34 in the control ring 31 and the upper face of the work rolls 33. For this reason the external diameter (denoted Y in FIG. 5(*d*)) of the flange 18 will be greater than the internal diameter (denoted X in FIG. 5(*c*)) of the die necked component presented to the rolling apparatus.

Figure 11:
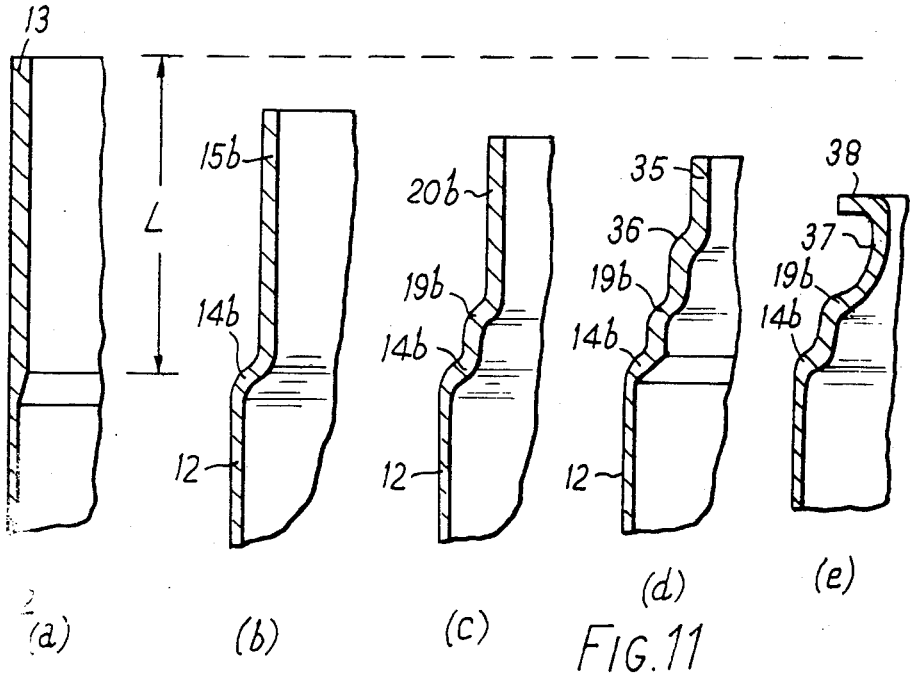
FIGS. 11*a,b,c,d, & e* show diagrammatically fragmentary sections of the side wall during a third embodiment of the method.

The third embodiment of the method as shown in FIG. 11 comprises taking a can body having a relatively thick rim as shown in FIG. 11(*a*), subjecting the rim to a sequence of three successive die necking operations (FIGS. 11(*b*), (*c*) and (i d) and thereafter applying a roll to that portion of the neck produced by the third die necking operation to form the neck and flange of FIG. 11(*e*).

The can body of FIG. 11(*a*) was produced by drawing a cup 2.585".(65.6 mm) diameter from a disc cut from a sheet of aluminium alloy 0.0140" (0.36 mm) thick. The alloy of this example was aluminium with about 1¼% manganese, however other alloys may be used. The side wall 12 of the drawn cup was wall ironed to a wall thickness of about 0.005" (0.13 mm) leaving a marginal rim portion 13 some 0.0075" (0.19 mm) thick and an axial length sufficient for the neck and flange. However, if desired some of the tapered portion may be formed into the neck.

The first die necking operation reduces the diameter of the marginal rim from 2.585" (65.6 mm) to a neck portion 15*b* about 2.462" (62.5 mm) supported on a first shoulder 14*b* as shown in FIG. 11(*b*). The second die necking operation reduces the diameter of an upper portion of the neck portion 15*b* of FIG. 11(*b*) to a neck portion 20*b* about 2.360" (59.0 mm) supported on a second support 19*b* as shown in FIG. 11(*c*). The third die necking operation reduces the diameter of an upper portion of the neck portion 20*b* of FIG. 11(*c*) to a third neck portion 35 of a diameter of 2.260" (57.4 mm) supported on a third shoulder portion 36.

In contrast to the method of FIG. 5 in which all the steps in the neck were rolled to create a smooth neck, in the method of FIG. 11 only the outermost neck portion 35 and shoulder portion 36 are rolled to create a smooth neck 37 and flange 38. In FIG. 11 the minimum diameter of the neck portion 37 as produced by rolling, is 2.063" (52.4 mm).

Figure 12:
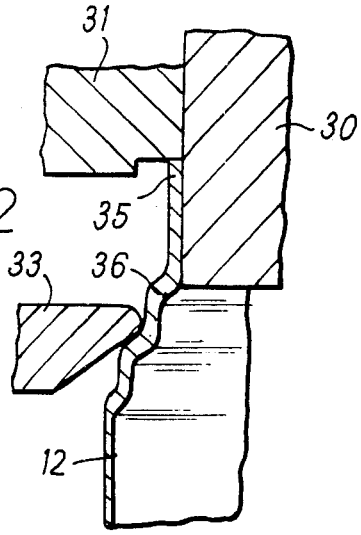
FIG. 12 shows the roll position at the start of neck rolling in the method of FIG. 11.

The apparatus shown in FIG. 12 works in the same way as the apparatus described with reference to FIGS. 7, 8 and 9. The chuck 30 is entered into the can body to support the neck portion 35 while the rolls, such as that denoted 33, roll the third shoulder portion 36 and neck portion 35 into the neck 37 and flange 38 shown in FIG. 11(*e*).

Figure 13:
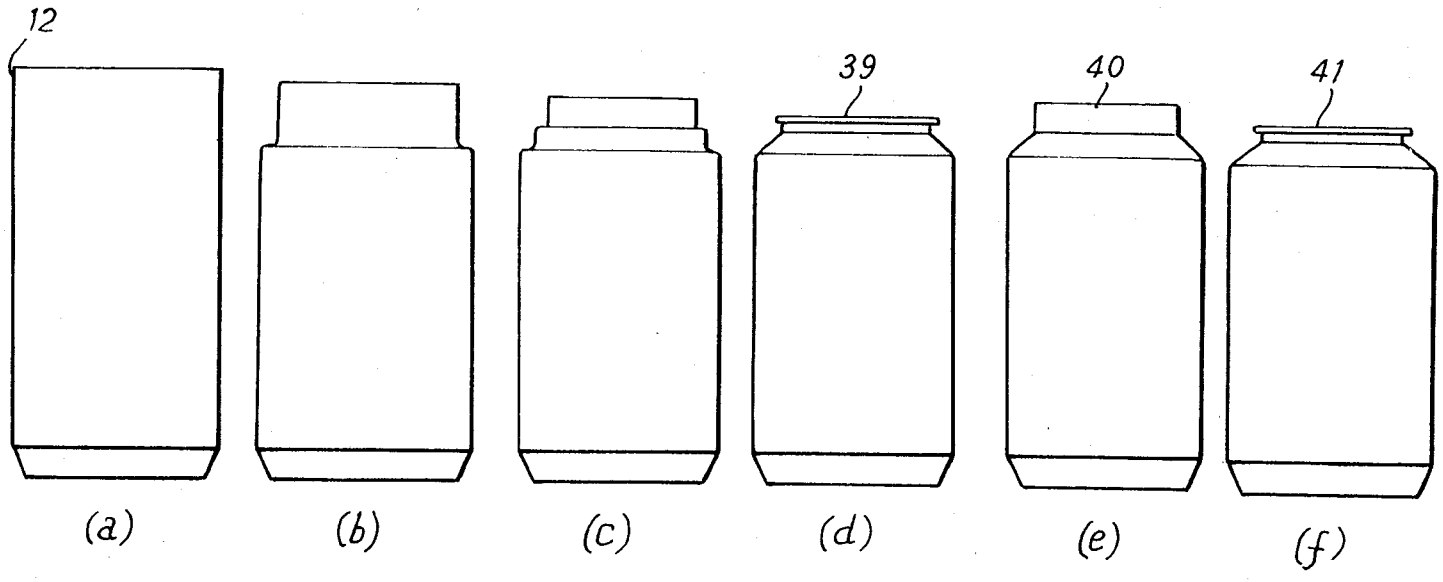
FIGS. 13*a,b,c,d,e* and *f* shows diagrammatically the sequence of neck shapes produced by a fourth embodiment of the method.

FIG. 13 shows diagrammatically a fourth embodiment of the method which may be applied to tinplate or aluminium bodies. In this embodiment a tinplate body is subjected to two die necking operations shown in FIGS. 13(*b*) and 13(*c*) followed by three rolling operations shown as FIGS. 13(*d*), 13(*e*) and 13(*f*).

In FIG. 13(*a*) the can body has a cylindrical sidewall 12, of diameter 2.585" (65.6 mm) defining the mouth of the can. The first and second die necking operations, the products of which are depicted in FIGS. 13(*b*) and 13(*c*), reduce the diameter of the mouth to a diameter of 2.510" (63.8 mm) and 2.410" (61.2 mm) respectively, substantially in the manner described with reference to FIG. 5.

A rolling operation, as already described with reference to FIG. 5 was used to produce the flanged body of FIG. 13(*d*) having an internal neck diameter of 2.210" (56.1 mm) so producing a flange 39 of diameter smaller than that depicted in FIG. 5. The flange is removed by further rolling to produce the can body of FIG. 13(*e*), the mouth of which is defined by a cylindrical neck portion 40 of 2.245" (57 mm) diameter. This further rolling causes the slight increase in internal neck diameter.

Further rolling of the neck portion 40 of the can body of FIG. 13(*e*) generates a smooth neck of minimum diameter 2.063" (52.4 mm) terminating in an outwardly directed flange 41 (FIG. 13(*f*) suitable for double seaming to a can end of the 202 size in conventional can making nomenclature.

From comparison of the embodiments of the method of the invention, it will be understood that the method may comprise various combinations of die necking and rolling operations to form a shoulder, neck and flange of reduced diameter on a can body.

We claim:

1. A method of forming a shoulder, neck and flange at an open end of the cylindrical side wall of a can body, comprising a die necking operation followed by a rolling operation, wherein the die necking operation includes a static die necking step in which a marginal edge portion defining the open end of the side wall is forced into a die to make a portion of reduced diameter having a shoulder portion supporting a cylindrical portion, the rolling operation includes a rolling step in which the portion of reduced diameter is rolled so as to further reduce the diameter of the cylindrical portion and generate a rereduced shoulder supporting said neck, and forming a flange at a terminal end portion of said cylindrical portion.

2. A method according to claim 1 wherein the die necking operation includes a plurality of said die necking steps performed in succession each in a separate die and each producing a respective one said portion of reduced diameter, and the rolling operation includes at least one said rolling step in which at least the portion of reduced diameter made in the last die necking step is by rolling reduced to generate said rereduced shoulder supporting said neck and said flange.

3. A method according to claim 1 wherein said rolling operation comprises supporting the can body in axial compression whilst deforming the can body adjacent to said open end by applying an axial shortening force thereto simultaneously with an inward radial force.

4. A method according to claim 3, wherein said can body is supported endwise between a can bottom support element and an axial thrust member, with a terminal edge of said body, defining said open end, engaging said thrust member, relative axial movement being effected between said support element and thrust member to maintain said endwise support as the can body is shortened during application of said radial force.

5. A method according to claim 3, wherein a pilot element is disposed with a first tool circumferential tool edge thereof coaxially within said body, said radial force being applied by a second tool edge spaced from said first tool edge by a distance having a constant axial component, said first edge acting as a fulcrum for the deformation of the can body.

6. A method according to claim 5, wherein the second tool edge is moved radially with respect to the can body.

7. A method according to claim 5, wherein the can body, supported in axial compression, is subjected to relative axial movement between itself and said tool edges, whereby the neck and flange are formed progressively towards said terminal edge.

8. A method according to claim 1, comprising the steps of: supporting said can body axially between a can bottom support element and an axial thrust member, with a terminal edge of said body at its open end engaging said thrust member, and with a pilot element, having a first circumferential tool edge, disposed with said first tool edge coaxially within the can body; and effecting relative axial movement between, on the one hand, the can body, support element and thrust member, and, on the other hand, said pilot element and a forming element having a second tool edge engaging said can body, whilst effecting relative radial movement between the can body and said second tool edge and relative axial movement between said support element and thrust member, so as to continue to support the can body whilst shortening it, whereby at least part of said flange and neck is formed in the can body by said second tool edge with said first tool edge acting as a fulcrum, said first and second tool edges being maintained in respective planes at a constant axial spacing from each other.

9. A method according to claim 8, wherein said forming element is a roller, said second tool edge being formed circumferentially thereof, and the roller being rotated about it own axis during formation of the neck and flange.

10. A method according to claim 8 or 9, wherein the can body is rotated about its own axis by simultaneous rotation of said support element and thrust member.

11. A method according to claim 8 or 9, wherein the said tool edges are maintained in fixed axial planes whilst the can body, support member and thrust member are moved axially with respect thereto.

12. A method according to any one of claims 1 to 9, wherein the can body is made of tinplate or aluminum or aluminum alloy.

13. A method according to any one of claims 1 to 9, wherein the marginal edge portion is thicker than the rest of the side wall of the can body.

14. A method according to any one of claims 1 to 9, wherein the diameter of the cylindrical portion to which rolls are applied is less than that of the diameter of the final flange produced.

15. A method of forming a shoulder, neck and flange on a can body comprising the steps of providing a generally frusto-conical forming surface defined by an entrance end surface portion of a greater diameter than an exit end surface portion with the latter merging with an external cylindrical forming surface in spaced relationship to an internal cylindrical forming surface, providing a can body having a cylindrical side wall including a terminal end portion having a diameter greater than that of the external cylindrical forming surface, axially aligning the can body with the external and internal cylindrical forming surfaces, progressively forcefully axially moving the terminal end portion of the can body along the entrance end surface portion toward the exit end surface portion and therebeyond between the external and internal cylindrical forming surfaces under an axial force sufficient to transform the terminal end portion of the can body into a radial shoulder portion and a reduced axial neck portion of a diameter less than that of the first-mentioned diameter and establishing a predetermined axial distance between a juncture of said radial shoulder portion and the remainder of the cylindrical side wall and a terminal edge of the reduced axial neck portion, providing at least one external roller, effecting relative rotation between the roller and the can body, and during the latter progressively forcefully radially inwardly moving the roller against the reduced neck portion to further reduce the diameter thereof for only a part of the axial distance between the radial shoulder and the terminal edge to form a rolled rereduced neck portion of an axial length shorter than said predetermined axial distance, and therewith forming a peripheral flange at said terminal end portion.

* * * * *